US007472806B2

(12) United States Patent
Good

(10) Patent No.: US 7,472,806 B2
(45) Date of Patent: Jan. 6, 2009

(54) CHILD RESISTANT MANUALLY ACTUATED DISPENSING DEVICE

(75) Inventor: Robert James Good, Lee's Summit, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 410 days.

(21) Appl. No.: 11/225,256

(22) Filed: Sep. 13, 2005

(65) Prior Publication Data

US 2007/0056991 A1 Mar. 15, 2007

(51) Int. Cl.
*B67B 5/00* (2006.01)

(52) U.S. Cl. ..... 222/153.14; 239/333; 222/383.1

(58) Field of Classification Search ..... 222/153.14, 222/383.1, 380, 153.1, 153.13, 391, 566, 222/401, 402.1, 402.11, 402.13; 215/209–221, 215/305; 239/333
See application file for complete search history.

(56) References Cited

U.S. PATENT DOCUMENTS 4,204,614 A 5/1980 Reeve
4,257,561 A 3/1981 McKinney
4,516,695 A 5/1985 Garneau
4,747,523 A 5/1988 Dobbs
5,078,288 A * 1/1992 Fuchs ..... 215/209
5,161,716 A 11/1992 Knickerbocker
5,228,600 A 7/1993 Steijns et al.
5,383,564 A * 1/1995 Hamilton et al. ..... 215/221
5,535,952 A 7/1996 Tada
5,662,246 A 9/1997 Contaxis, III
6,186,366 B1 2/2001 Good et al.
6,227,411 B1 5/2001 Good
6,478,193 B1 * 11/2002 Good et al. ..... 222/153.14
2004/0251316 A1 12/2004 Stark
2005/0082311 A1 4/2005 Good et al.

* cited by examiner

*Primary Examiner*—Lien T Ngo
(74) *Attorney, Agent, or Firm*—Gordon & Jacobson, PC

(57) ABSTRACT

A child resistant manually actuated dispensing pump device includes a rotatable nozzle cap having a flange which defines a notch and an outer shroud having a tab which is dimensioned to engage the notch and lie substantially flush with or recessed relative to the flange so that it cannot be grasped and pulled out of the notch. When the tab is engaged in the notch, the nozzle cap cannot be rotated. The shroud is made of material which is flexible enough that it can be bent away from the nozzle cap, thereby lifting the tab out of the notch and permitting rotation of the cap. A second embodiment replaces the notch with a pair of ledges located on opposite sides of the nozzle cap, and provides a second tab on the opposite side of the shroud so that each tab engages a ledge.

12 Claims, 5 Drawing Sheets

CHILD RESISTANT MANUALLY ACTUATED DISPENSING DEVICE

INCORPORATION BY REFERENCE

Co-owned U.S. Pat. No. 4,747,523 is hereby incorporated by reference herein in its entirety.

BACKGROUND OF THE INVENTION

1. Field of the Invention

This invention relates broadly to a manually actuated fluid dispenser. More particularly, this invention relates to a fluid dispenser having a rotatable nozzle cap and shroud which interlock to prevent the nozzle from rotating.

2. State of the Art

Co-owned U.S. Pat. No. 4,747,523 discloses a manually actuated dispensing pump which includes a trigger actuator, an outer shroud and a rotatable nozzle cap. The rotatable nozzle cap is rotatable to three positions: stream, spray, and off. This dispensing pump and those like it are typically used on bottles of household cleaners which are toxic if swallowed and harmful if sprayed in the eyes. It is therefore desirable to equip these pumps with a "child lock". Several child lock designs have been proposed for this type of pump including the locking assembly shown in co-owned U.S. Pat. No. 5,050,779. All of the child lock solutions proposed thus far suffer from one or more of the following disadvantages: they are too complex; they are too difficult to operate; or they are too easy to operate (i.e. they are ineffective in preventing a child from unlocking the cap).

SUMMARY OF THE INVENTION

It is therefore an object of the invention to provide a child resistant manually actuated dispensing device.

It is another object of the invention to provide a child resistant manually actuated dispensing device which is simple in design.

It is a further object of the invention to provide a child resistant manually actuated dispensing pump which is easy for an adult to operate.

It is also an object of the invention to provide a child resistant manually actuated dispensing device which is difficult or impossible for a child to operate.

In accord with these objects, which will be discussed in detail below, a child resistant manually actuated dispensing device includes a rotatable nozzle cap having a radially extending flange which defines a notch and an outer shroud having a tab which lies in the plane of and extends from the front of the shroud, and which is dimensioned to engage the notch and lie substantially flush with the flange so that it cannot be grasped and pulled out of the notch. The shroud is made of material which is sufficiently flexible such that it can be pulled away from the nozzle cap at a location on the same side of the tab thereby causing the tab to lift out of the notch and permitting rotation of the nozzle. The tab is not otherwise liftable out of the notch and therefore acts to prevent rotation of the nozzle when engaged. According to the presently preferred embodiment, the flange is substantially rectangular with chamfered corners and two notches are provided directly opposite each other.

In another embodiment, the child resistant manually actuated dispensing device includes a rotatable nozzle cap having a radially extending flange which includes two oppositely disposed ledges and an outer shroud having two tabs which lie in the plane of and extend from the front of the shroud, and which are dimensioned to engage the ledges and lie substantially flush with the ledges so that they cannot be grasped and pulled off of the ledges. The shroud is made of material which is sufficiently flexible such that it can be pulled away from the nozzle cap at locations near the tabs thereby causing the tabs to lift off of the ledges. Pulling the shroud at one location permits rotation of the nozzle in a first direction, and pulling the shroud at the other location permits rotation of the nozzle in a second (opposite) direction. The tabs are not otherwise liftable off of the ledges.

It will be appreciated that when the shroud is bent away from the nozzle cap, the chamfered corners of the flange facilitate rotation of the nozzle cap.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
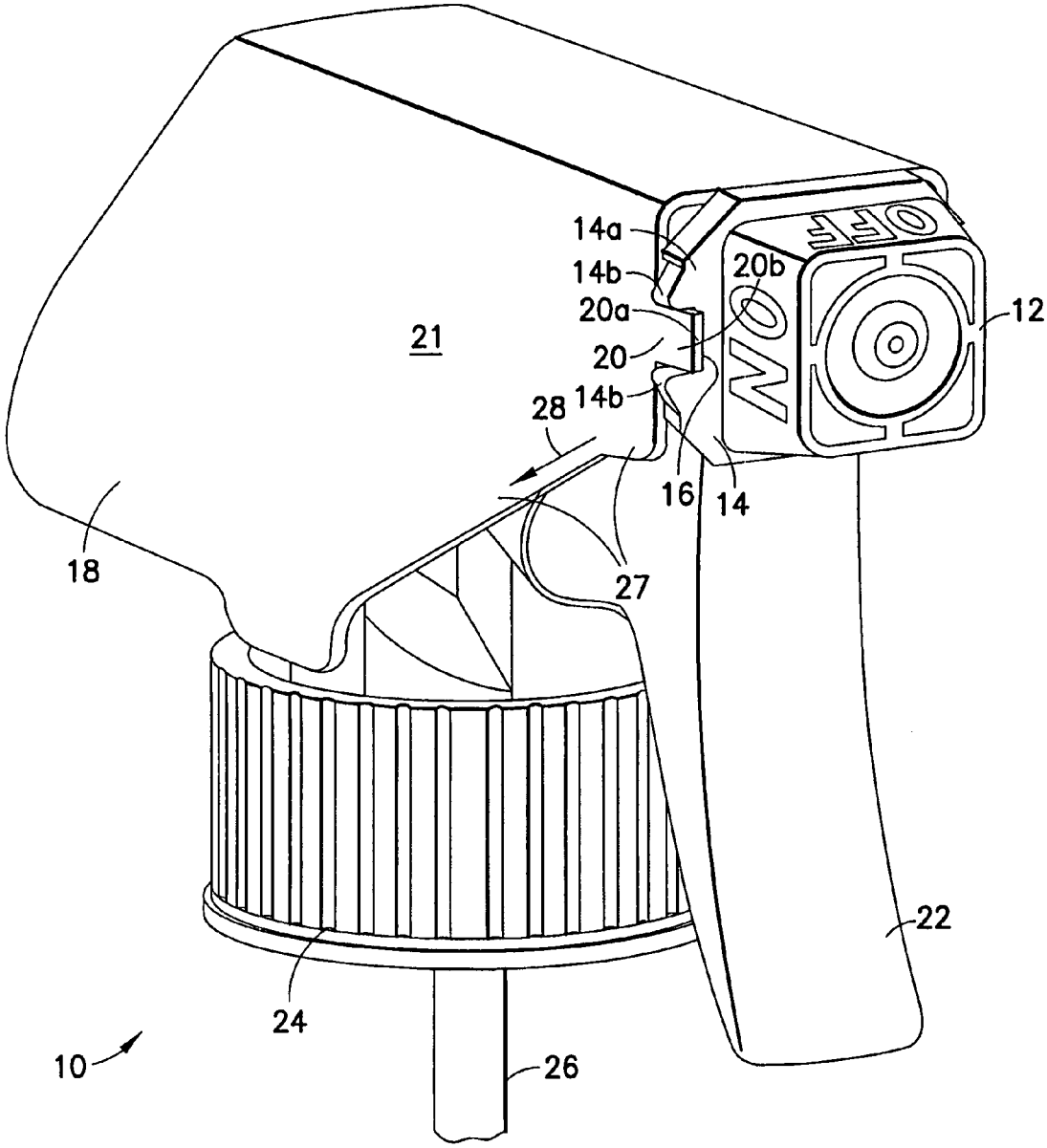
FIG. 1 is a perspective view of a manually actuated dispensing pump according to the invention.
Figure 2:
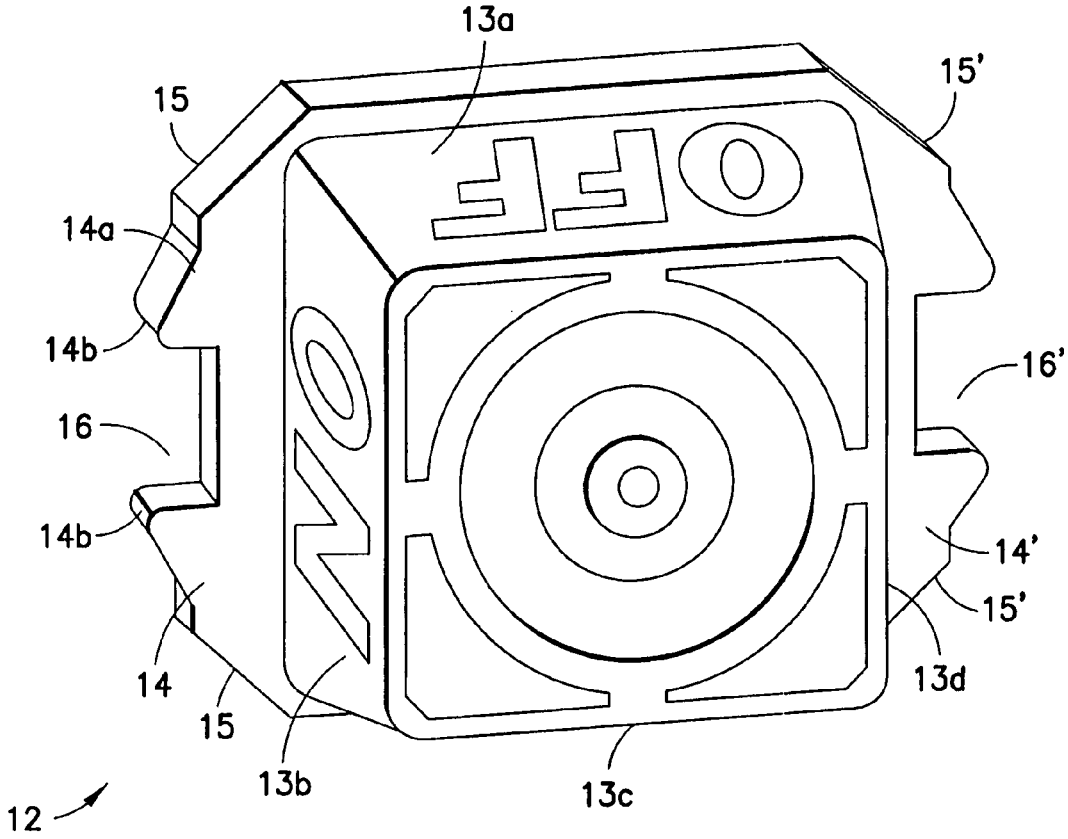
FIG. 2 is a perspective view of a first embodiment of the nozzle cap.
Figure 3:
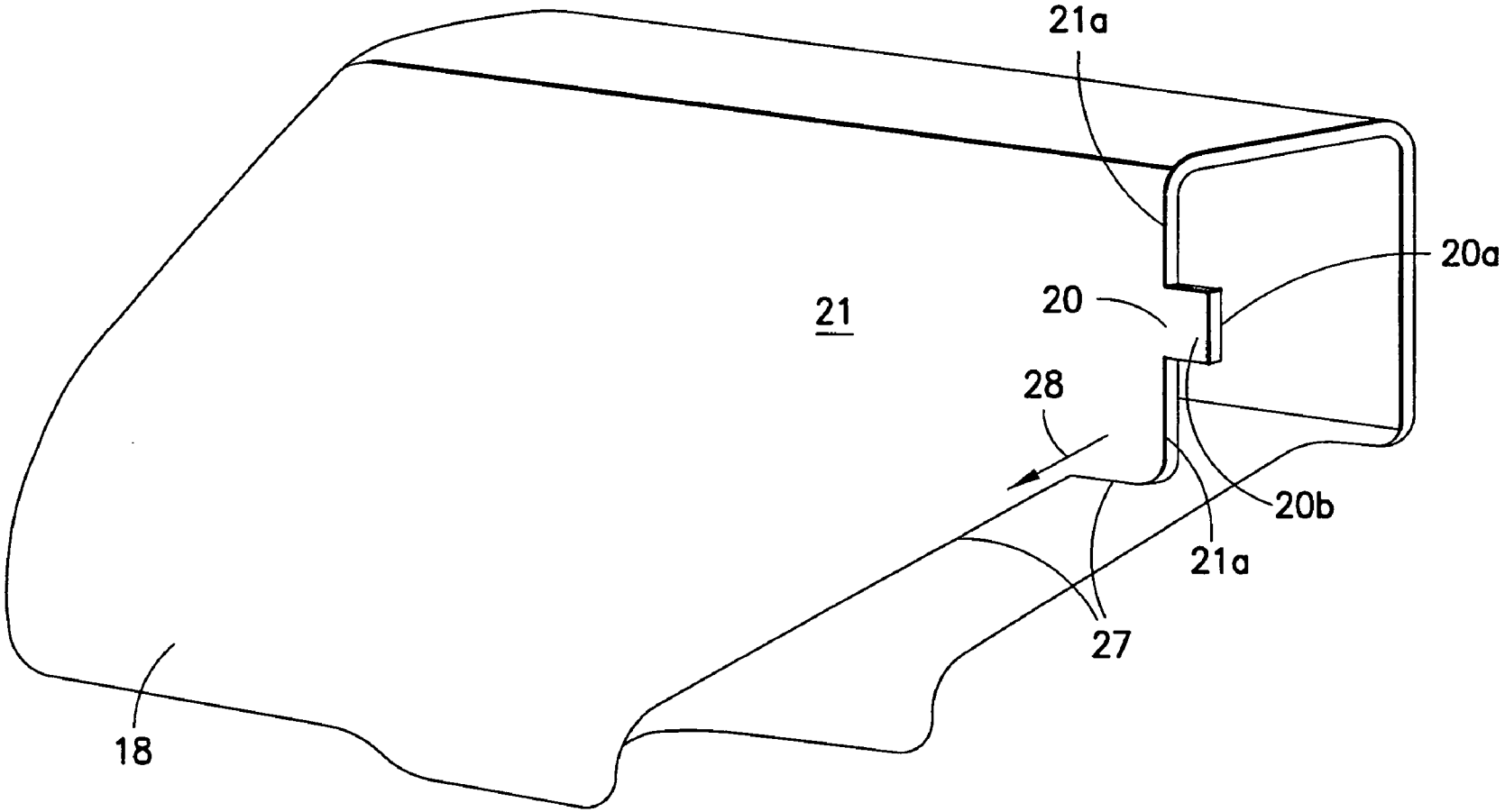
FIG. 3 is a perspective view of a first embodiment of the shroud.

Turning now to FIGS. 1-3, a child resistant manually actuated dispensing pump 10 includes a rotatable nozzle cap 12 having a radially extending flange 14 defining a notch 16 and a shroud 18 having a tab 20. The tab 20 lies in the plane of a side wall 21 of the shroud and extends from the front end 21*a* of the shroud and is dimensioned to engage the notch 16 and lie substantially flush with the flange 14 so that said tab cannot be grasped and pulled out of the notch 16. The pump 10 also includes a trigger 22, a bottle cap 24 and a feed tube 26. In particular, the tab 20 has a forward edge 20*a* which lies flush with a front face 14*a* of the flange 14. Thus, in exemplary embodiments, where the flange 14 may have a thickness of between 1/10 inch and 1/2 inch, the tab 20 has a substantially similar length so that its forward edge lies flush with the front face of the flange. Also, the tab 20 optionally has a thickness such that a side face 20*b* of the tab 20 is substantially flush with tips 14*b* of the flange 14 defined by notch 16. Alternatively, the thickness of the tab (which is preferably the same thickness as that of the shroud) causes the tab to be recessed in the notch. The shroud 18 is preferably made from a thin (e.g. approximately 0.03-0.04 inch thick) plastic (e.g., polypropylene) which is sufficiently flexible and resilient (e.g., the flex modulus at 23° C. is 1480 Mpa when tested per ASTM D790A) to permit temporary bending of the shroud sufficient to permit the tab to exit the notch and permit rotation of the nozzle. The inner workings of the pump are substantially as described in previously incorporated U.S. Pat. No. 4,747,523.

As seen best in FIG. 2, the nozzle cap 12 has four sides 13*a*, 13*b*, 13*c*, and 13*d*. Each side bears indicia which indicates the function of the pump. For example, as illustrated, side 13*a* indicates that the pump is OFF and 13*b* indicates that the pump is ON. In a typical embodiment, sides 13*a* and 13*c* will indicate OFF and the other two sides will indicate SPRAY and STREAM respectively. Accordingly, two radially extending flanges 14 and 14' are provided, each defining a notch 16,16' so that the nozzle cap may be locked at either of the OFF positions. According to the preferred embodiment, the flanges 14 and 14' are chamfered at corners 15, 15'.

As seen best in FIGS. 1 and 3, the shroud 18 exhibits a lower edge 27 which can be grasped and pulled in the direction shown by the arrow 28 (out of the page) which is at a portion of the shroud which extends behind and down from the tab 20. When this is done, the tab 20 is lifted out of the notch 16 thus allowing the nozzle cap 12 to be rotated to an "on" position. The chamfered corners 15, 15' facilitate rotation behind the lifted tab 20. In addition, it will be appreciated that the chamfered corners 15, 15' allow the user to rotate the nozzle cap 12 from an "on" position to an "off" position without having to lift the shroud outward, as a corner push tab 20 outward until it snaps into a notch 16 or 16'.

Figure 4:
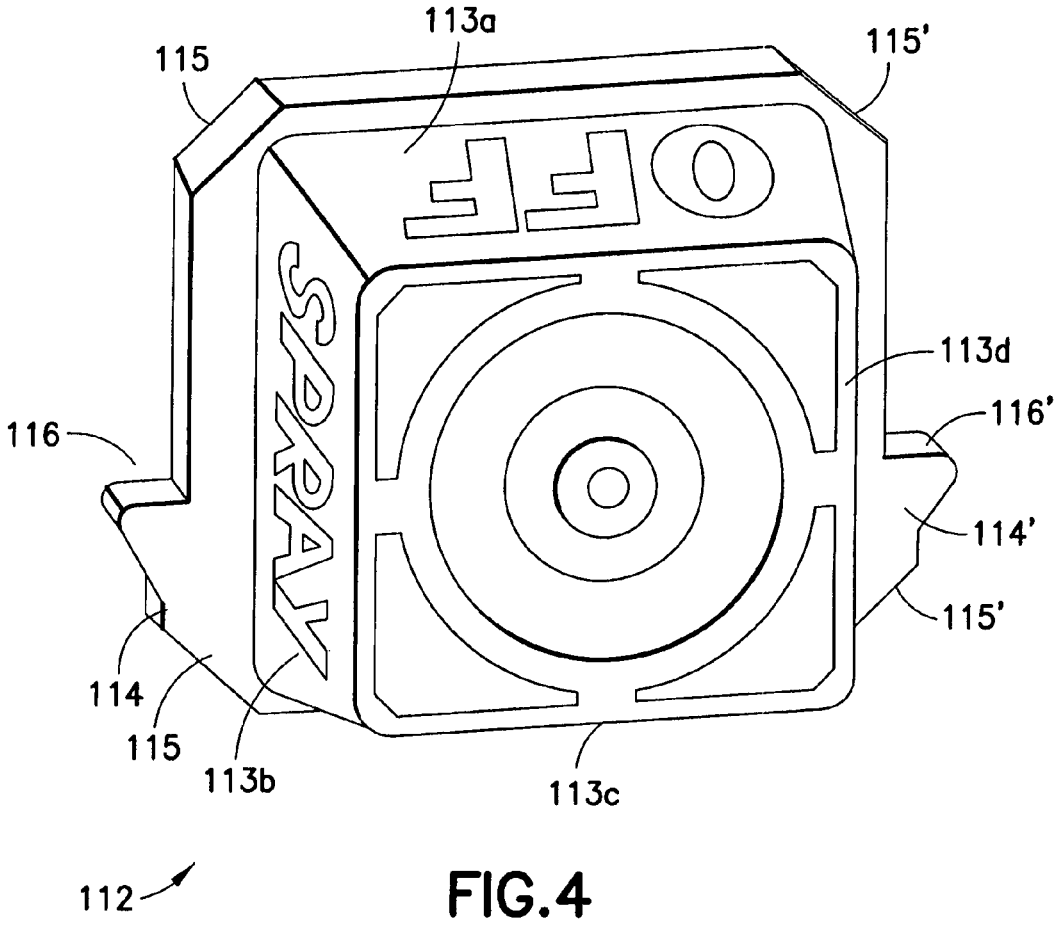
FIG. 4 is a perspective view of a second embodiment of the nozzle cap.

Turning now to FIG. 4, in a second embodiment, a nozzle cap 112 has four sides 113*a*, 113*b*, 113*c*, and 113*d*. Each side bears indicia which indicates the function of the pump. For example, in a typical embodiment, sides 113*a* and 113*c* will indicate OFF and the other two sides will indicate SPRAY and STREAM respectively. Two radially extending flanges 114 and 114' are provided, each defining a ledge 116, 116' so that the nozzle cap may be locked at either of the OFF positions. The flanges 114 and 114' are preferably chamfered at corners 115, 115'.

Figure 5:
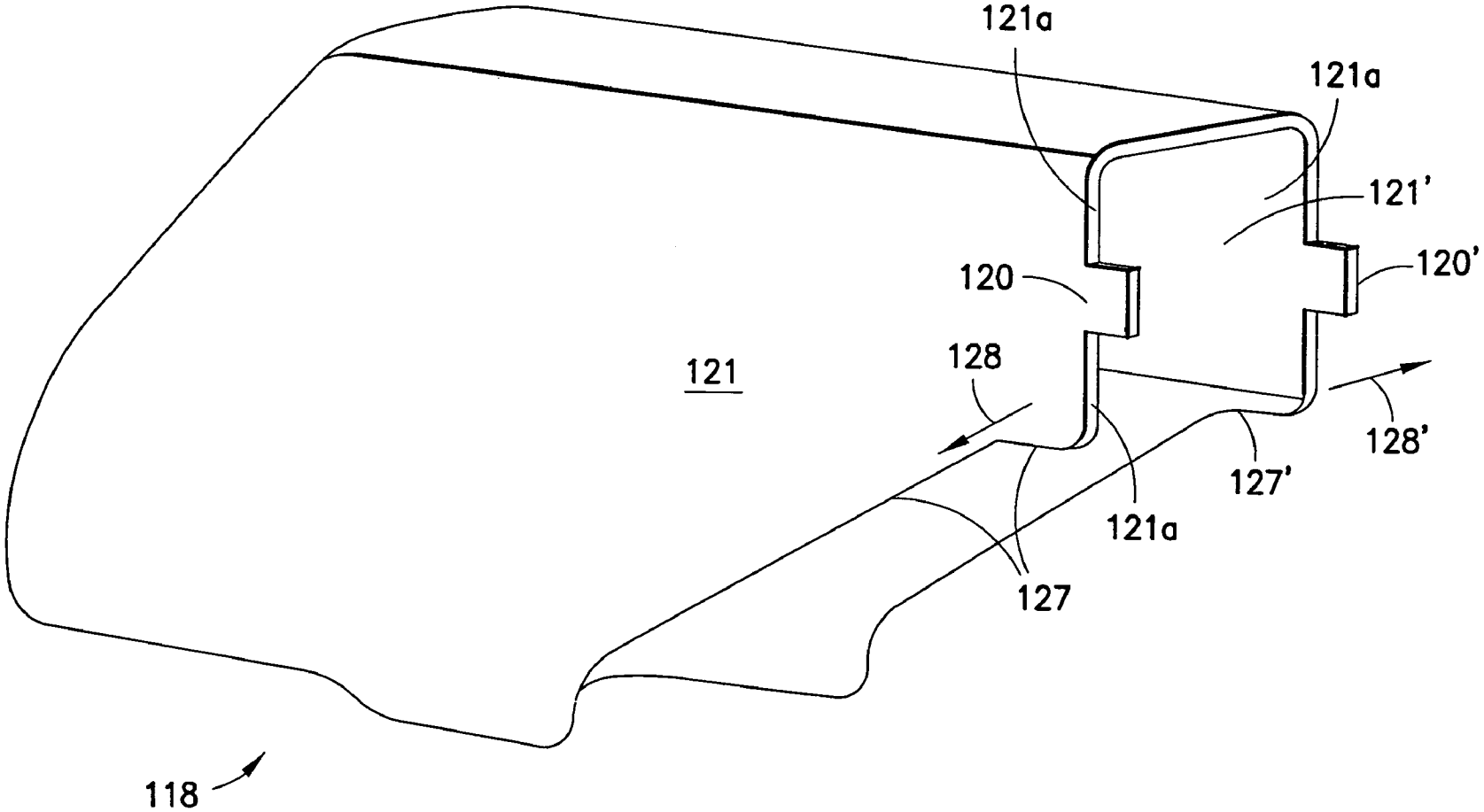
FIG. 5 is a perspective view of a second embodiment of the shroud.

The nozzle cap 112 shown in FIG. 4 is designed to operate in conjunction with the shroud 118 shown in FIG. 5 which is similar to the shroud 18 except that it has two oppositely disposed tabs 120, 120'. Tabs 120 and 120' lie in the planes of a side walls 121, 121' of the shroud and extend from the front end 121*a* of the shroud. Referring now to FIGS. 4 and 5, the shroud 118 exhibits a lower edge 127 which can be grasped and pulled in the direction shown by the arrow 128 (out of the page) which is at a portion of the shroud which extends behind and down from the tab 120. When this is done, the tab 120 is lifted away from the ledge 116 thus allowing the nozzle cap 112 to be rotated to the SPRAY position but not to the STREAM (not shown) position. The chamfered corners 115 facilitate rotation behind the lifted tab 120. In addition, the chamfered corners facilitate rotation of the nozzle cap 112 to the OFF position without having to lift the shroud as discussed above with reference to the first embodiment. The shroud 118 also exhibits a second lower edge 127' below and behind tab 120'. This edge can be grasped and pulled in the direction shown by the arrow 128' (into the page). When this is done, the tab 120' is lifted away from the ledge 116' thus allowing the nozzle cap 112 to be rotated to the STREAM (not shown) position but not to the SPRAY position. Again, the chamfered corner 115' facilitates rotation behind the lifted tab 120' and facilitates rotation back to an OFF position without lifting of the shroud It should be appreciated by those skilled in the art that while the forward edges of the tabs of both embodiments are preferably substantially flush with (e.g., within 1/32 of an inch on the front faces of the flanges, the forward edges of the tabs may be recessed relative to the front faces. The potential problem with a recessed tab and even a substantially flush tab is that the tabs of the shrouds tend to back out of the notches (or away from the ledges) when attempts are made to force rotation of the nozzle cap against the tab(s). One manner of preventing this problem is to make the flange thickness large enough (e.g., 1/4 inch thick or more) so that the relative movement of the shroud to the nozzle cap during a forced rotation of the nozzle cap is not large enough to permit the tab to back out of the notch or off the ledge. Alternatively, while less desirable, it is possible and permissible to have the forward edges of the tabs extend beyond the front faces of the flanges provided that the tabs are sufficiently rigid such that a finger purchase of the tab away from the notch or ledge will not remove the tab from the notch or ledge.

There have been described and illustrated herein embodiments of a child resistant manually actuated dispensing device. While particular embodiments of the invention have been described, it is not intended that the invention be limited thereto, as it is intended that the invention be as broad in scope as the art will allow and that the specification be read likewise. Thus, while the tab has been described as preferably lying substantially flush with the flange or ledge, it will be appreciated that the tab could be recessed from the flange or ledge in one or two directions. Also, the tab could be thicker and longer than the notch or ledge provided it cannot be directly lifted from the notch or ledge. It will therefore be appreciated by those skilled in the art that yet other modifications could be made to the provided invention without deviating from its spirit and scope as claimed.

What is claimed is:

1. A child resistant manually actuated dispensing device, comprising:

a rotatable nozzle cap having a radially extending flange which defines a notch; and an outer shroud having a side wall and having an integral tab extending from and in a plane of said side wall, said tab being dimensioned to engage said flange and be recessed relative to or lie substantially flush with said notch so that said tab cannot be grasped and pulled out of said notch, wherein said shroud is made of material which is sufficiently flexible such that said shroud can be pulled away from the nozzle cap to thereby lift the tab out of the notch, the tab is not movable out of the notch without pulling said shroud away from the nozzle cap, and the flange is substantially rectangular with chamfered corners and two notches are provided directly opposite each other.

2. A device according to claim 1, wherein:

said tab has a front edge, said flange has a front face, and said front edge is substantially flush with said front face.

3. A device according to claim 1, wherein:

said tab has a front edge, said flange has a front face, and said front edge is recessed from said front face.

4. A device according to claim 1, wherein:

said tab has a thickness, said notch has a depth, and said thickness and said depth are substantially equal.

5. A device according to claim 1, wherein:

said tab has a thickness, said notch has a depth, and said thickness is less than said depth.

6. A device according to claim 1, wherein:

said shroud has a portion which extends behind and down from said tab.

7. A child resistant manually actuated dispensing, comprising:

a rotatable nozzle cap having a radially extending flange which defines a pair of oppositely disposed ledges; and an outer shroud having opposite side walls and having a pair of integral tabs extending from and in planes of said side walls, each of said pair of tabs being dimensioned to engage one of said flanges and be recessed relative to or lie substantially flush with said ledge, wherein said shroud is made of material which is sufficiently flexible such that said shroud can be pulled away from the nozzle cap to thereby lift each of said pair of tabs away from its respective ledge, said pair of tabs are not movable away from their respective ledges without pulling said shroud away from the nozzle cap, and the flange is substantially rectangular with chamfered corners.

8. A device according to claim 7, wherein:

each tab has a front edge, said flange has a front face, and said front edge is substantially flush with said front face.

9. A device according to claim 7, wherein:

each tab has a front edge, said flange has a front face, and said front edge is recessed from said front face.

10. A device according to claim 7, wherein:

each tab has a thickness, each ledge has a depth, and said thickness and said depth are substantially equal.

11. A device according to claim 7, wherein:

each tab has a thickness, each notch has a depth, and said thickness is less than said depth.

12. A device according to claim 7, wherein:

said shroud has a portion which extends behind and down from said tab.

* * * * *